United States Patent [19]

Rutty

[11] Patent Number: 4,757,927

[45] **Date of Patent: * Jul. 19, 1988**

[54] HOLDER FOR SUSPENDING RULE CLIP OR THE LIKE

[75] Inventor: Edward C. Rutty, Portland, Conn.

[73] Assignee: The Stanley Works, New Britain, Conn.

[ * ] Notice: The portion of the term of this patent subsequent to Oct. 28, 2003 has been disclaimed.

[21] Appl. No.: 768,462

[22] Filed: Aug. 22, 1985

Related U.S. Application Data

[63] Continuation-in-part of Ser. No. 732,577, May 10, 1985, abandoned.

[51] Int. Cl.[4] ..... A45F 5/00

[52] U.S. Cl. ..... 224/253; 224/269; 224/904; 24/10 A

[58] Field of Search ..... 24/10 A; 224/252, 253, 224/269, 904

[56] References Cited

U.S. PATENT DOCUMENTS

| | | | |
|---|---|---|---|
| 727,402 | 5/1903 | Messer . | |
| 781,629 | 2/1905 | Ahlstrom . | |
| 1,267,052 | 5/1918 | Burnett | 224/252 X |
| 2,578,237 | 12/1951 | Geistweit | 224/253 X |
| 3,659,759 | 5/1972 | Walton . | |
| 3,886,773 | 6/1975 | McGahee . | |
| 3,970,227 | 7/1976 | Hardy . | |
| 3,992,776 | 11/1976 | Koppe et al. . | |
| 4,226,006 | 10/1980 | Toyama . | |
| 4,299,345 | 11/1981 | Lanzl | 224/252 |
| 4,358,036 | 11/1982 | Maltais . | |
| 4,406,385 | 9/1983 | Pribyl | 224/252 |
| 4,619,020 | 10/1986 | Lecher, Sr. | 24/10 A |

*Primary Examiner*—Henry J. Recla
*Assistant Examiner*—David Voorhees

[57] ABSTRACT

A holder is provided for suspending a measuring rule or similar object, to which is attached a spring clip having an inwardly declined deflectable tongue portion thereon. The holder is of relatively flat configuration and is adapted to be inserted over or upon the belt of the user. It may be of generally U-shaped configuration, with an outer leg having a laterally extending slot configured to receive the tongue portion of the spring clip and defining a relatively narrow lower edge element about which the rule can swing freely, so as to minimize any tendency for inadvertent disassembly. Alternatively, the holder may be of generally rectangular, plate-like form and with edge slots through which the belt is inserted, while still retaining the lower edge feature described. The construction of the holder facilitates one-handed attachment and removal of the rule, without diminishing the security of interengagement afforded.

8 Claims, 3 Drawing Sheets

HOLDER FOR SUSPENDING RULE CLIP OR THE LIKE

CROSS REFERENCE TO RELATED APPLICATION

This application is a continuation-in-part of copending application for Letters Patent Ser. No. 732,577, filed on May 10, 1985 now abandoned.

BACKGROUND OF THE INVENTION

Spring clips are commonly provided on tape rule casings, tools and the like, so that such objects can be carried in a handy position on a belt or other garment part, and readily removed for use. By themselves, however, clips of this type are not optimal in certain respects, particularly as concerns the facility and security of engagement that they afford. It is often found necessary to use both hands to insert the supporting belt into the clip, and it is not uncommon for the rule to become disengaged inadvertently, such as by contact of the instrument or tool with a part of the user's body; he is of course inconvenienced in both cases. A further disadvantage resides in the fact that the frequent attachment and removal of the clip causes unsightly marring, and undue wear, of the belt.

The broad idea of providing a supplemental belt-supported holder, for attachment of an article, a ring, or the like, is well known in the art and has been developed in a variety of forms, as evidenced by the following U.S. Pat. Nos.: 727,402; 781,629; 3,659,759; 3,886,773; 3,970,227; 3,992,776; 4,226,006; and 4,358,036. Each of the foregoing discloses a member adapted for engagement upon a belt, waistband, or other garment part. In particular, the Koppe et al patent (U.S. Pat. No. 3,992,776) provides a spring metal band having a first, belt-retaining portion adjacent its upper end and a pair of curvilinear portions adjacent its lower end, which provide spring tension for holding a knife sheath; the Hardy patent (U.S. Pat. No. 3,970,227) shows a belt clip which has an out-turned lip 22 and an inner bend 25; and the Maltais U.S. Pat. No. 4,358,036 discloses a belt clip having a pocket portion for receiving a tongue of a clip permanently fastened to a tool or other object (see FIG. 7).

Despite such patent art, a need has remained for a holder that is capable of facile assembly with a tape rule or other object having a spring clip or similar supporting fixture thereon, for securely engaging the same against inadvertent disassembly. Of course, any such holder must itself be readily and yet securely engaged on the belt or other garment part and, as a practical matter, must also be relatively facile and inexpensive to manufacture.

In copending and commonly assigned application Ser. No. 732,681 filed on May 10, 1985 in the name of Bernard G. Lecher, Sr. and entitled RULE CLIP HOLDER FOR BELT OR THE LIKE, a holder is disclosed and claimed which satisfies, to a substantial extent, the foregoing needs. Nevertheless, the holder may not be found to be optimal in all respects, such as with regard to the level of security that it provides against inadvertent disassembly of the supported object.

Accordingly, it is an object of the present invention to provide a novel holder for suspending a tool or other article, such as a measuring rule, having a spring clip or like fixture with a resiliently deflectable tongue or insert portion thereon, which holder readily receives and securely engages the insert portion, and cooperates therewith to minimize the chance of inadvertent disassembly.

It is also an object of the invention to provide such a holder which is itself easily placed and securely affixed or mounted upon a belt or other supporting part, and is relatively facile and inexpensive to manufacture.

SUMMARY OF THE INVENTION

It has now been found that certain of the foregoing and related objects of the invention are readily attained in a holder comprising a member having a relatively wide (in a lateral sense) and substantially planar lower portion with a laterally extending slot formed therethrough adjacent its lower edge, and having means thereon for mounting it upon the user's belt. A relatively narrow marginal element is defined between the slot and the lower edge of the member; the slot is dimensioned and configured for facile insertion of the tongue portion of the spring clip of the object to be supported, and the belt-mounting means is positioned above the slot so as to avoid interference between the belt and the inserted spring clip. The marginal element is sufficiently narrow to provide adequate clearance for movement within the space defined near the upper connecting portion of the spring clip, and it is substantially free from any inward or outward offset; as a result, relatively free pivoting of the mounted object thereabout is enabled.

Certain objects of the invention are attained by the provision of a holder comprised of generally parallel inner and outer legs, joined for resilient relative deflection by an upper connecting portion and adapted to engage a belt or similar supporting part inserted upwardly into it. The outer leg is substantially longer than the inner one, and has a relatively wide and substantially planar lower portion. A laterally extending slot is formed through the lower portion adjacent the bottom edge of the outer leg, and is dimensioned and configured for facile insertion of a spring clip tongue portion. The slot defines a relatively narrow marginal element therebelow, and may itself be defined by an inwardly offset upper lip element and an outwardly offset lower lip element, which cooperatively facilitate insertion of the tongue portion. The inner leg of the clip terminates short of the slot in the outer leg, so as to avoid contact with the spring clip inserted therethrough, and the marginal element is dimensioned and configured to allow the mounted object to pivot freely thereabout.

In the latter form of holder, the inner leg may also have a relatively wide and substantially planar lower portion, with both of the legs desirably having lower portions with inwardly extending terminal elements thereon to facilitate insertion of the belt and to hamper inadvertent disengagement. The member comprising the holder will usually be integrally formed as a single piece from a resiliently deflectable material, such as spring steel, and it will advantageously be of substantially uniform width along its entire length.

DETAILED DESCRIPTION OF THE ILLUSTRATED EMBODIMENTS

Figure 1:
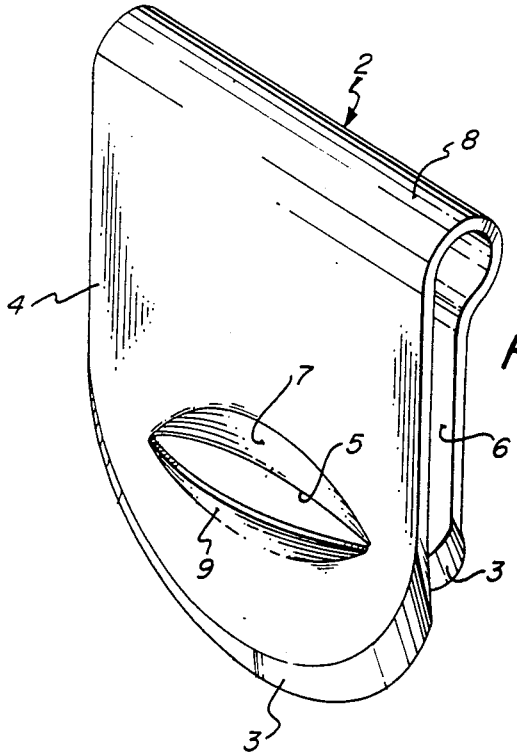
FIG. 1 is a perspective view showing a holder of the type to which the present invention is directed.
Figure 2:
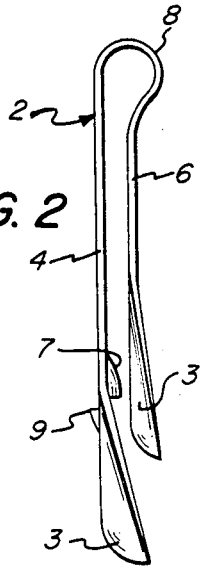
FIG. 2 is an elevational view of the holder of FIG. 1.
Figure 3:
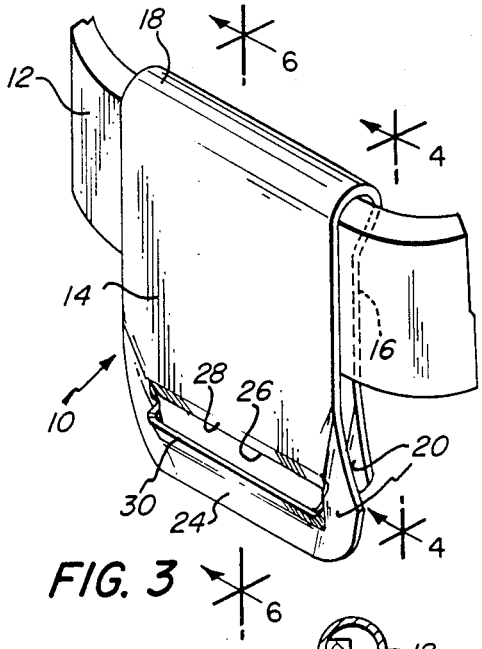
FIG. 3 is a perspective view of a holder embodying the present invention, engaged upon a belt which is fragmentarily illustrated.

Turning first to FIGS. 1 and 2 of the appended drawing, therein illustrated is a holder, generally designated by the numeral 2, broadly showing the type of device to which the invention is directed, but devoid of certain novel features thereof. The holder is of relatively flat, generally U-shaped cross section, and is integrally formed from a single strip of spring steel or the like, bent upon itself to provide an outer leg 4 and a shorter inner leg or tang 6, both of which extend downwardly (in the position of normal use) from a curvilinear upper connecting portion 8.

Each of the legs 4, 6 is generally planar, and has a lower portion 3 which is inwardly curled; the curved portion on the inner leg facilitates mounting of the holder upon the belt, and that on the outer leg provides an element beneath the lower edge of a belt on which it is mounted, positioned to interfere therewith and thus minimize the chance of inadvertent disassembly. In addition, the lower portion of the outer leg 4 has an elongated, laterally extending slot 5 formed through it, defined by upper and lower lip elements 7, 9, which curve inwardly and outwardly, respectively, from the plane of the leg.

FIGS. 3–8 illustrate a holder embodying the invention, which is generally designated by the numeral 10 and is shown in position on a belt 12. Like the holder of FIGS. 1 and 2, it is also of relatively flat, generally U-shaped cross section, and is similarly formed from a single strip to provide an outer leg 14 and a shorter inner leg 16, which extend from the curvilinear connecting portion 18.

Figure 4:
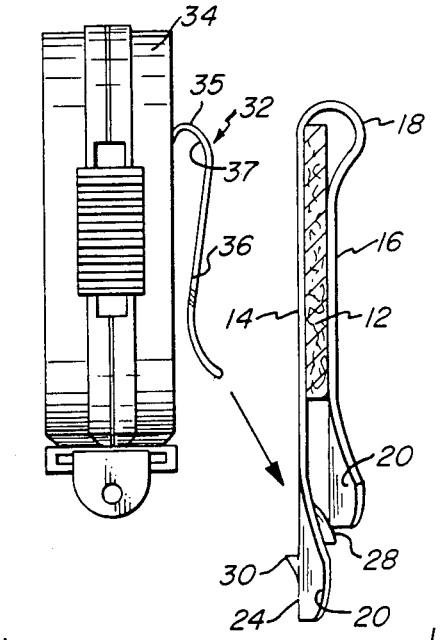
FIG. 4 is an elevational view of the holder of FIG. 3, taken through line 4–4 thereof and also showing a measuring rule positioned for insertion of the tongue portion of its spring clip into the holder slot.
Figure 7:
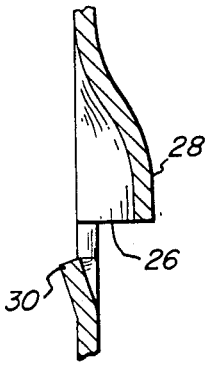
FIG. 7 shows a portion of FIG. 6 in the area of the slot, drawn to a greatly enlarged scale.
Figure 6:
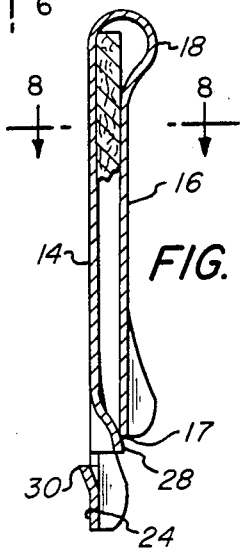
FIG. 6 is a sectional view of the holder, taken along line 6—6 of FIG. 3 and showing a fragment of the belt.
Figure 8:
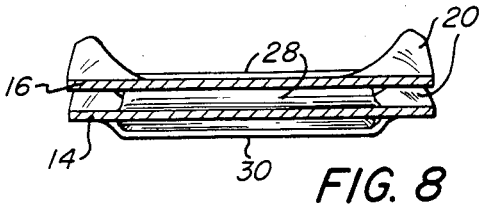
FIG 8 is a sectional view taken along line 8—8 of FIG. 6, drawn to a scale slightly enlarged therefrom and with the belt removed.
Figure 5:
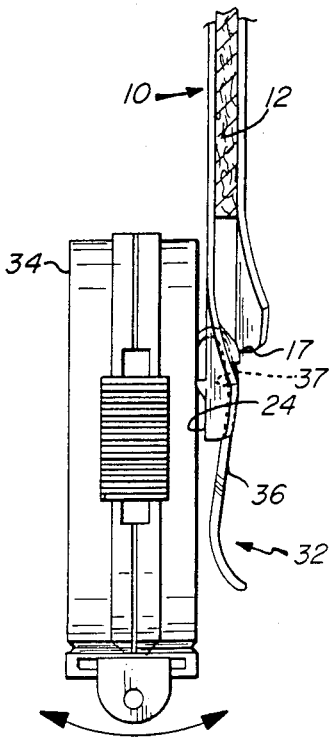
FIG. 5 is a fragmentary view, similar to FIG. 4, showing the rule assembled with the holder.

Each of the generally planar legs 14, 16 has lower corner portions 20 which are inwardly curled to perform the same functions of the portions 3 of the embodiments of FIGS. 1 and 2; their relationship to the belt 12 is best seen in FIGS. 4 and 5. In addition, the lower portion of the outer leg 14 has a slot 26 similarly defined by curved upper and lower lip elements 28, 30. In this instance however the marginal element 24, defined on the outer leg 14 below the slot 26, is relatively narrow (i.e., relatively small in its top-to-bottom dimension), and the terminal edge 17 of the tang 16 is biased to a normal position against the inner surface of the upper lip element 28; also the section under the lip element 30 is free of inward or outward offset (i.e., the planar configuration is maintained).

In FIGS. 4 and 5, a measuring tape rule of standard design is associated with the holder 10. It includes a conventional retaining spring clip, generally designated by the numeral 32, attached to one side of its casing 34 and having a resiliently deflectable tongue portion 36. The latter declines toward the casing from an upper connecting portion 35, and defines a space 37 which is relatively wide at the top and tapers toward the free end of the tongue portion.

As depicted in FIG. 5 the holder is attached to the belt, and supportingly engages the rule; the tongue portion 36 of the clip 32 thereof is inserted through the slot 26 of the outer leg 14, to thereby seat the upper connecting portion 35 upon the outwardly extending lower lip element 30. Because the marginal element 24 is narrow, the distance that the outer leg 14 projects into the space 37 is limited, thereby avoiding undue interference with the clip and permitting the rule to pivot freely on the edge of the lip element 30, as suggested by the double-headed arrow in FIG. 5. This in turn allows the rule to yield rather than being displaced (and thereby disassembled), such as by contact with the hip or upper thigh of the user when he bends or crouches, and consequently the form of the holder shown in FIGS. 3–8 represents a significant improvement upon that of FIGS. 1 and 2.

In the two embodiments illustrated by FIGS. 1–8, however, the mutually offset relationship of the lip elements 7, 9 and 28, 30, respectively, and the positioning of the slots 5 and 26 well below the upper edge of the belt, will contribute to the facility of assembly and removal of the rule, which can normally be achieved with one hand. Also, the upper lip elements and the bent portions at the lower edges of the outer legs cooperate with the inner legs to retain the holder upon the belt. It will generally be necessary that the legs of the holder be flexed somewhat, for insertion as well as for removal; conversely, their inherent tension helps to minimize the possibility that disassembly will occur inadvertently. The relative positions and configurations of the lower portions of the two legs will, on the other hand, make attachment to the belt easy and convenient; moreover, since the supported article remains in place the damage that might otherwise be caused to the belt, by its frequent removal and replacement, will be substantially reduced.

Figure 9:
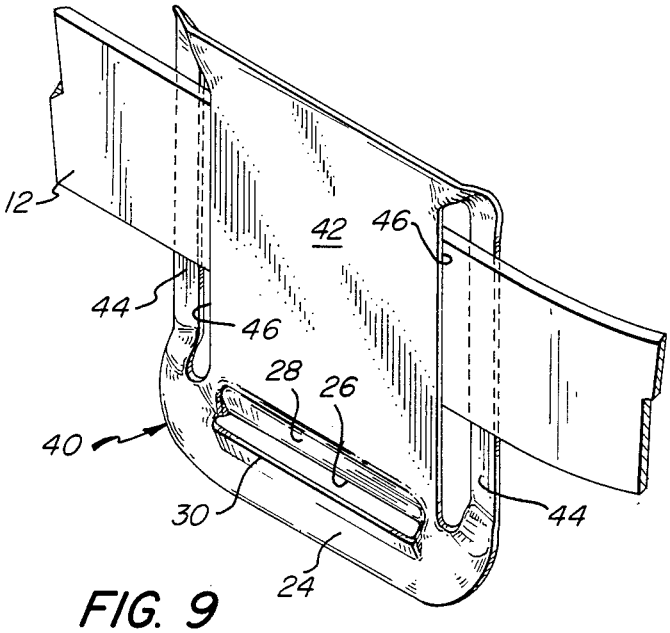
FIG. 9 is a perspective view similar to FIG. 3, showing a second embodiment of the holder of the invention mounted upon a belt, which is fragmentarily illustrated.
Figure 10:
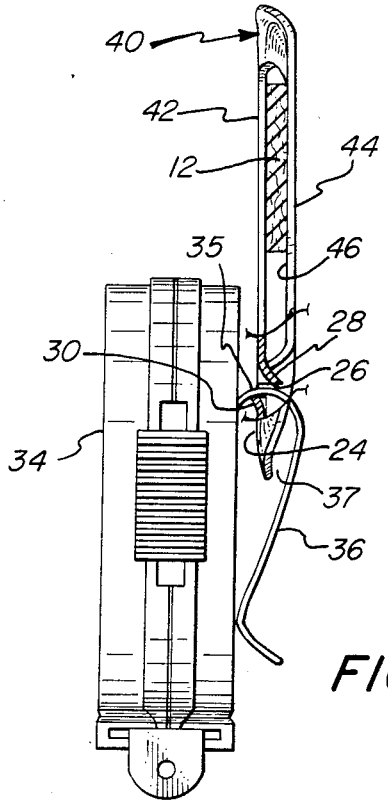
FIG. 10 is a fragmentary view similar to FIG. 5 showing a rule assembled with the holder of FIG. 9, a broken-away section in the area of the bottom slot being delineated by two S-shaped lines.

Turning now to FIGS. 9 and 10, a second form of holders embodying the invention is generally designated by the numeral 40, and consists of one generally planar piece having a central panel portion 42, along both sides of which longitudinally extending marginal elements 44 are rearwardly offset to define slots 46, through which the user's belt 12 is threaded. Thus, the main difference between the holder (40) of these Figures and that (10) of FIGS. 3–8 lies in the elimination of the rearward leg 16 in the present embodiment, and the provision of the integral passage formed by the panel portion 42 and the elements 44.

The lower portion of the holder 40 has a slot 26 formed therein and defined by curved upper and lower lip elements 28, 30, with the marginal element 24 defined below the slot 26 being planar and of relatively small top-to-narrow dimension. As depicted in FIG. 10, the holder 40 supportingly engages the rule with the tongue portion 36 of the clip 32 thereof inserted through the slot 26, thereby seating the upper connecting portion 35 upon the outwardly extending lower lip element 30. Once again, because the marginal element 24 is narrow, the distance that the holder projects into the space 37 is limited, thereby avoiding undue interference with the clip and permitting the rule to pivot freely on the edge of the lip element 30; the absence of any substantial inward or outward offset in that portion of the holder also avoids undue interference with such movement.

Consequently, the holder of FIGS. 9 and 10 offers the advantage of yielding, against inadvertent disassembly, as is also provided by the embodiment of FIGS. 3–8. In addition, it is easier and even less expensive to manufacture, because the amount of material used for construction is reduced, and it presents no possibility of accidental removal from the user's belt.

Typically a holder of the form shown in the last two figures will be generally rectangular, with lateral and longitudinal outside dimensions (expressed in millimeters, and parenthetically in inches) of 63.5 (2.5) and 70 (2.756), respectively. The length and width of the bottom slot of such a holder may desirably be about 41 (1.614) and 1.6 (0.063), to thereby provide a lower marginal element with a top-to-bottom dimension of about 7.7 (0.303). From the standpoint of permitting freedom of movement of the rule on the holder, the last-mentioned dimension is of course the most significant; although the actual measurement will depend to some extent upon the area within the clip of the rule or other object to be supported, as a practical matter it will not generally exceed 15 millimeters (0.59 inch) at any point thereacross.

As noted above, the holder will desirably be fabricated from a uniformly wide strip or panel of spring steel, and conventional bending and stamping operations may be used. It will however be appreciated that other materials (notably plastics) can be substituted, with suitable fabrication methods being adopted, as appropriate. Specific aspects of manufacture, as well as variations in design, will be evident to those skilled in the art from the foregoing detailed description, and need not therefore be discussed in further detail.

Thus, it can be seen that the present invention provides a novel holder for suspending an article, such as a measuring rule, having a spring clip or like fixture with a resiliently deflectable tongue or insert portion thereon. The holder readily receives and is securely engaged by the tongue portion of the clip, and cooperates therewith to minimize the chance of inadvertent disassembly. The holder itself is easily placed and securely affixed upon a belt, and is relatively facile and inexpensive to manufacture.

Having thus described the invention, what is claimed is:

1. A holder for supporting a measuring rule or like object, which object has a spring clip thereon with a resiliently deflectable tongue portion declining inwardly from an upper connecting portion defining a substantial space thereadjacent, said holder comprising an integrally formed member having a relatively wide and substantially planar lower portion with an elongated, laterally extending slot formed therethrough adjacent the lower edge of said member and defining an elongated, relatively narrow marginal bottom element between said slot and said lower edge, said slot being dimensioned and configured for facile insertion of the tongue portion of the spring clip of the object to be supported, the holder having the portion thereof extending along the upper edge of said slot inwardly offset to provide an inwardly offset upper lip element defining the upper edge of said slot and said marginal element of said member being sufficiently narrow to provide adequate clearance for movement within the space of the spring clip so as to allow relatively free pivoting of the mounted object thereabout, said member also having means thereon spaced above said slot for engaging the user's belt at a level above said slot so as to avoid interference between the belt and the spring clip inserted through said slot.

2. The holder of claim 1 wherein a portion of said holder extending along the bottom edge of said slot is outwardly offset to provide an outwardly offset lower lip element defining the lower edge of said slot, both of said lip elements being curled in their respective directions.

3. The holder of claim 1 wherein said piece has a pair of longitudinally extending slots formed therethrough along its opposite side edges and extending perpendicularly to said first mentioned slot to define a pair of marginal side elements outwardly thereof and a medical element therebetween, said longitudinal slots being adapted to receive a belt threaded between said side and medial elements, and thereby comprising said engaging means of said holder.

4. The holder of claim 3 wherein said member is of substantially rectangular configuration, and wherein said side elements are offset from the plane of said medial elements to facilitate threading of a belt therebetween.

5. The holder of claim 1 wherein said bottom marginal element has a top-to-bottom dimension that does not exceed about 15 millimeters at any point, and is substantially free from any inward or outward offset other than said lower lip element.

6. In combination, an object having a spring clip thereon with a resiliently deflectable tongue portion declining inwardly from an upper connecting portion and defining a substantial space thereadjacent; and a holder comprising an integrally formed member having a relatively wide and substantially planar lower portion with an elongated laterally extending slot formed therethrough adjacent the lower edge of said member and defining an elongated, relatively narrow marginal bottom element between said slot and said lower edge, said slot being dimensioned and configured for facile insertion of the tongue portion of said spring clip of said object, the holder having a portion thereof extending along the upper edge of said slot inwardly offset to provide an inwardly offset upper lip element defining the upper edge of said slot, said object having said tongue portion inserted through said slot to thereby mount said object on said holder, said bottom marginal element being sufficiently narrow to provide adequate clearance for movement within said space of said spring clip, so as to allow relatively free pivoting of said mounted object thereabout, said member also having means thereon spaced above said slot for engaging the user's belt at a level above said slot so as to avoid interference between the belt and the spring clip inserted through said slot.

7. The combination of claim 6 wherein said piece has a pair of longitudinally extending slots formed therethrough along its opposite side edges and extending perpendicularly to said first mentioned slot to define a pair of marginal side elements outwardly thereof and a medial element therebetween, said longitudinal slots being adapted to receive a belt threaded between said side and medial elements, and thereby comprising said engaging means of said holder.

8. The combination of claim 7 wherein said bottom marginal element has a top-to-bottom dimension that does not exceed about 15 millimeters at any point, and is substantially free from any inward or outward offset other than said lower lip element.

* * * * *

UNITED STATES PATENT AND TRADEMARK OFFICE

CERTIFICATE OF CORRECTION

PATENT NO. : 4,757,927

DATED : July 19, 1988

INVENTOR(S) : Edward C. Rutty

It is certified that error appears in the above-identified patent and that said Letters Patent is hereby corrected as shown below:

Column 5, line 58, after "portion" insert --and--.

Column 6, line 22, "medical" should be --medial--.

Column 7, line 4, "7" should be "6".

Signed and Sealed this

Twenty-ninth Day of November, 1988

*Attest:*

*Attesting Officer*

DONALD J. QUIGG

*Commissioner of Patents and Trademarks*